US011684867B2

(12) United States Patent
Grapsas

(10) Patent No.: US 11,684,867 B2
(45) Date of Patent: Jun. 27, 2023

(54) 3D TILE

(71) Applicant: Dimitrios Grapsas, Agrinio (GR)

(72) Inventor: Dimitrios Grapsas, Agrinio (GR)

( * ) Notice: Subject to any disclaimer, the term of this patent is extended or adjusted under 35 U.S.C. 154(b) by 137 days.

(21) Appl. No.: 17/416,812

(22) PCT Filed: Nov. 19, 2019

(86) PCT No.: PCT/GR2019/000081

§ 371 (c)(1),
(2) Date: Jun. 21, 2021

(87) PCT Pub. No.: WO2020/144484

PCT Pub. Date: Jul. 16, 2020

(65) Prior Publication Data

US 2022/0080329 A1 Mar. 17, 2022

(30) Foreign Application Priority Data

Jan. 10, 2019 (GR) ..... 20190100006

(51) Int. Cl.
*A63H 33/08* (2006.01)

(52) U.S. Cl.
CPC ..... *A63H 33/086* (2013.01)

(58) Field of Classification Search
CPC .... A63H 33/062; A63H 33/065; A63H 33/08; A63H 33/088
USPC ..... 446/117, 120, 121, 124
See application file for complete search history.

(56) References Cited

U.S. PATENT DOCUMENTS

| | | | | |
|---|---|---|---|---|
| 3,374,917 | A * | 3/1968 | Troy | E04B 2/18 297/DIG. 2 |
| 3,487,579 | A * | 1/1970 | Brettingen | A63H 33/086 446/128 |
| 3,873,096 | A * | 3/1975 | Shoptaugh | A63F 9/12 446/124 |
| 3,877,170 | A * | 4/1975 | Bakker | A63H 33/088 446/124 |
| 6,086,444 | A * | 7/2000 | Glickman | A63H 33/08 446/124 |
| 8,002,241 | B1 * | 8/2011 | Shaw | B60P 3/36 254/5 C |
| 8,961,259 | B2 * | 2/2015 | Maggiore | A63H 33/065 446/124 |
| 9,808,734 | B2 * | 11/2017 | Kuo | E04B 2/22 |
| 10,130,894 | B2 * | 11/2018 | Peiler | A63H 33/086 |
| D949,978 | S * | 4/2022 | Heo | D21/487 |
| 2002/0106963 | A1 * | 8/2002 | Chiu | A63H 33/086 446/125 |
| 2017/0209802 | A1 * | 7/2017 | Sisamos | A63H 33/062 |
| 2020/0222821 | A1 * | 7/2020 | Lange | A63H 33/088 |
| 2020/0282323 | A1 * | 9/2020 | MacArthur | A63H 33/102 |

* cited by examiner

*Primary Examiner* — Joseph B Baldori

(57) ABSTRACT

The invention relates to a three-dimensional tile, of metal or plastic, having at least one face (1) with an octagonal socket (2) and another face (1) with an octagonal projection (3). Each tile is joined in this way with a similar tile, forming structures in space. The octagonal socket (2) has an inner embossed cord (7) miming along it to which a tooth (6) carried on the straight sections (4), which together with the corner sections (5) form the octagonal projection (3), attaches. The 3D tile can be used to create structures of both aesthetic and utility nature.

2 Claims, 5 Drawing Sheets

3D TILE

FIELD OF ART

The invention relates to the field of 3D construction art, and in particular to a three-dimensional cube-shaped tile having octagonal sockets and corresponding octagonal protrusions, to form clusters by joining multiple tiles together.

BACKGROUND OF THE INVENTION

The three-dimensional tile disclosed in the present invention has not been disclosed in the prior art.

Tiles and construction bricks are already well known and marketed mainly as toys for children. These bricks are usually rectangular in shape but have a multitude of dimensions as well as shapes so that they can be combined to create the desired object. Due to the complexity and the multitude of structural elements for making any object, it is almost necessary to have an explanatory accompanying book detailing the combinations step by step to reach the end result. As is evident on the one hand, it is almost impossible to achieve the end result without providing guidance to the user, and in particular to a child, but on the other hand, blind adherence to an instruction book does not allow the child to develop his or her imagination and practice until achieving the desired result. In addition, the presence of a multitude of different structural elements often confuses the user, making it difficult to proceed with the construction. In addition, in the event of loss of any structural element(s), it is often impossible to complete the final object.

Another disadvantage of structural elements, such as bricks, used in the manufacture of objects is the fact that the development of arrays at an angle in space is impossible. This means that it is necessary to place them one on top of each other and deploy vertically to the plane, without being possible to place one structural element at an angle to another.

Another structural disadvantage that these bricks present to date is that usually the notches and protrusions that they have to attach to each other are round. The result is reduced structural stability, as they are often detached due to increased weight during construction.

It is thus an object of the present invention to address the aforementioned disadvantages and deficiencies of the prior art by proposing a three-dimensional tile, which allows the creation of objects in multiple, different shapes.

It is a further object of the present invention to provide a three-dimensional tile, wherein with the same element it is possible to develop a structure in space in all directions.

It is a further object of the present invention to provide a three-dimensional tile, which can be provided in different sizes, with exactly the same geometrical and structural features.

A further feature of the invention is the fact that the particular three-dimensional tile can stand, alone or in combination, independently on any flat surface.

A further object of the invention is to provide a three-dimensional tile having octagonal sockets, allowing for the creation of arrays even at an angle of 45°.

It is also an object of the present invention to provide a three-dimensional tile, which can be used by architects, sculptors, and may still be the essential element of a construction toy.

It is also an object of the present invention to provide a three-dimensional tile, its sockets having an embossed inner cord and its protrusions having teeth, allowing for a stable connection between the tiles, even when they are at an angle.

These and other objects, features and advantages of the invention will become apparent in the following detailed description.

BRIEF DESCRIPTION OF THE DRAWINGS

The invention will be apparent to those skilled in the art with reference to the accompanying drawings in which it is illustrated in a non-limiting manner.

DETAILED DESCRIPTION OF THE PREFERRED EMBODIMENT

Referring now to the accompanying drawings, we will describe illustrative embodiments of the three-dimensional tile in order to show both its advantages and its structural features.

Figure 1:
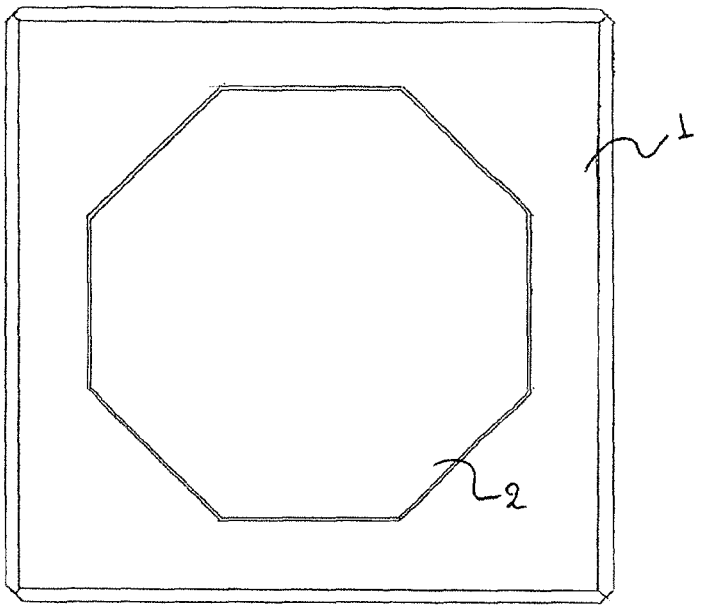
FIG. 1 shows a plan view of one of the sides of the three-dimensional tile of the present invention.
Figure 3:
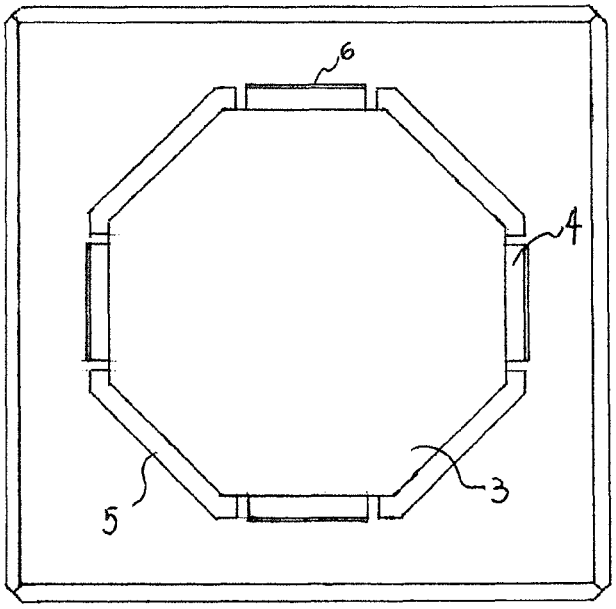
FIG. 3 shows a plan view of the three-dimensional tile side, with the octagonal protrusion attachable to one of the faces of another tile, to create the deployed structure in space.

The three-dimensional tile of the invention consists of 6 faces (1), FIG. 1, wherein at least one of the faces (1) has an octagonal socket (2). Each octagonal socket (2) has such a depth that it allows inserting an octagonal protrusion (3), FIG. 3, in such a way that the joined faces are in contact. Each three-dimensional tile has an octagonal protrusion (3).

Figure 4:
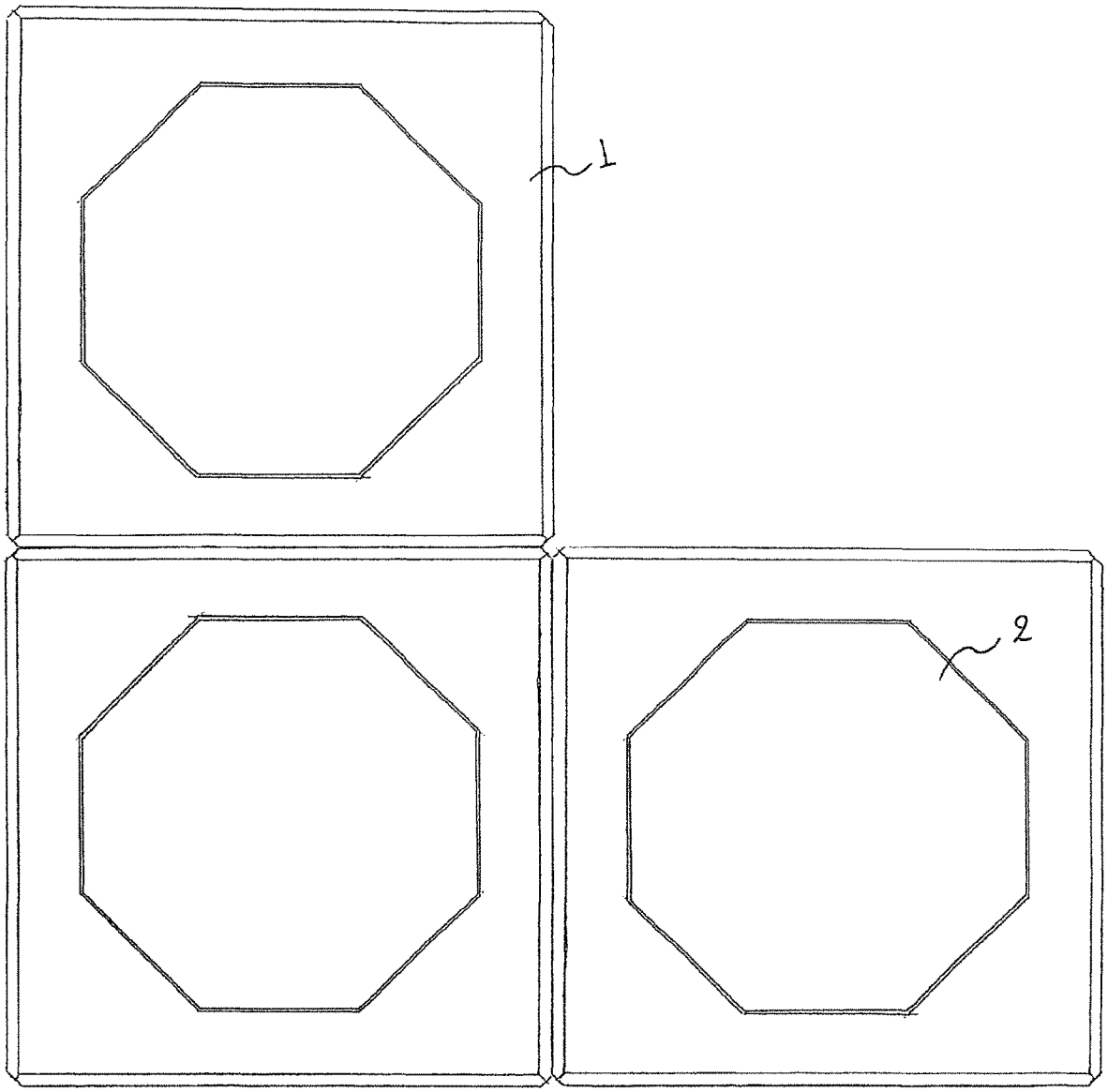
FIG. 4 shows an illustrative combination of three 3D tiles, in perspective view, to create a structure in space.

The 3D tile joining in the above manner contributes to the creation of three-dimensional structures, FIG. 4, that deploy in space and create shapes, extending to three dimensions, depending on the way the tiles are joined together.

Figure 2:
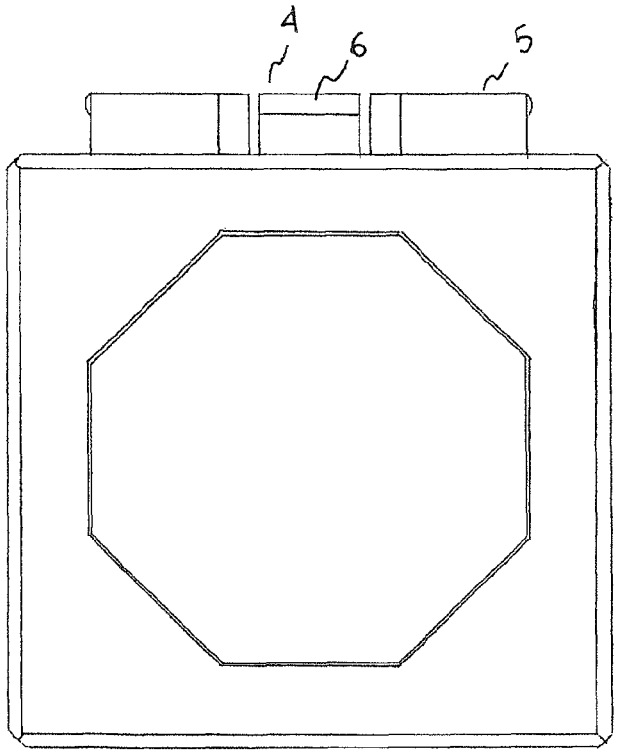
FIG. 2 shows a side view of the three-dimensional tile with the octagonal protrusion allowing for the creation of tile arrays.
Figure 5:
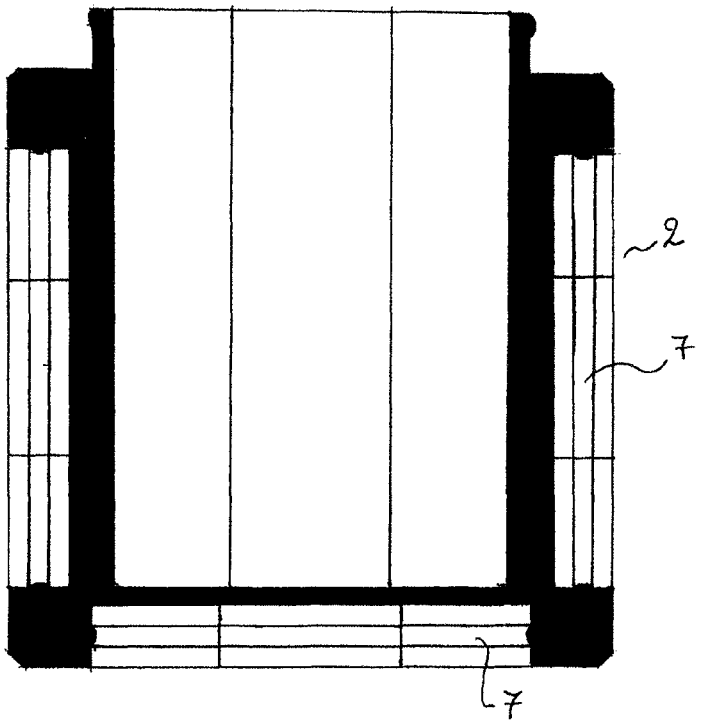
FIG. 5 shows a section of a three-dimensional tile showing the faces, with the sockets for inserting the protrusions. Correspondingly, the embossed inner cord running along the sockets is shown, allowing for the assembly and disassembly of three-dimensional tiles in structures extending into space.

The octagonal protrusion (3) is formed by separate sections, where the four straight sections (4) are per two parallel to each other and parallel to the edges of the cube, and there are four corner sections (5) located between the straight sections (4). The straight sections (4) play an important role in joining the three-dimensional tiles as they are flexible and have tolerances to allow the formed octagonal protrusion (3) to be inserted into the corresponding octagonal socket (2). To assemble and disassemble the three-dimensional tiles, the straight sections (4) have a tooth (6), FIG. 2, extending outwardly with respect to the straight section (4). Each tooth (6) enters the octagonal socket (2) when assembling the tiles and secures, by overlapping the corresponding tooth of an embossed inner cord (7), FIG. 5, extending along the interior of the octagonal socket (2). Consequently, due to its flexibility, the user has to exert slight pressure inwardly so that the octagonal protrusion (3) enters the octagonal socket (2) in such a way that the tooth (6) is secured by overlapping the opposite tooth of the embossed inner cord (7).

An important advantage of this particular connection and the presence of an embossed inner cord (7), all along the interior of the octagonal socket (2), is that the connection between two 3D tiles can be made even at an angle of 45°. In this way, the three-dimensional tile structures can extend to different levels and in different orientations in space, always using the same element.

The three-dimensional tile can be made of any material, but it is preferable to be made of plastic, such as the acrylonitrile butadiene styrene, known as abs, metal or a combination thereof.

It should be noted at this point that the invention was described with reference to illustrative examples of application, but not limited to. Thus any change or modification in the shape, dimensions, morphology, materials used and components of construction and assembly, as long as they do not constitute a new inventive step and do not contribute to the technical development of the already known are considered to be contained in the purposes and aspects of the present invention as summarized in claims below.

The invention claimed is:

1. A tile cube, comprising:

six faces, wherein at least one face of the six faces has an octagonal socket and at least one other face of the six faces has an octagonal protrusion each said octagonal protrusion formed by four straight members and four corner members, alternating between a straight member of the four straight members and a corner member of the four corner members, with oppositely oriented straight members of the four straight members being parallel to each other and to edges of the tile cube, each said straight member of the four straight members being flexible and separate from adjacent corner members of the four corner members, wherein each said straight member of the four straight members has an outwardly-oriented tooth, and wherein each said octagonal socket has an embossed inner protrusion extending inwardly along an interior of said octagonal socket and to which the tooth on each corresponding straight section of the four straight sections of another tile cube is attachable.

2. The tile cube of claim 1, wherein the embossed inner protrusion is attachable to the tooth of the octagonal protrusion of said another tile cube at up to a 45 degree angle.

* * * * *